US010793235B2

(12) United States Patent
Zhou

(10) Patent No.: US 10,793,235 B2
(45) Date of Patent: Oct. 6, 2020

(54) LYING RING FOR INFANTS

(71) Applicant: Weixin Zhou, Jinhua (CN)

(72) Inventor: Weixin Zhou, Jinhua (CN)

( * ) Notice: Subject to any disclaimer, the term of this patent is extended or adjusted under 35 U.S.C. 154(b) by 0 days.

(21) Appl. No.: 16/536,532

(22) Filed: Aug. 9, 2019

(65) Prior Publication Data

US 2020/0164952 A1 May 28, 2020

(30) Foreign Application Priority Data

Nov. 28, 2018 (CN) ..... 2018 2 1980092 U

(51) Int. Cl.
*B63B 34/50* (2020.01)
*B63B 34/00* (2020.01)

(52) U.S. Cl.
CPC ..... *B63B 34/50* (2020.02); *B63B 34/00* (2020.02)

(58) Field of Classification Search
CPC ..... B63B 34/50; B63B 34/00
See application file for complete search history.

(56) References Cited

U.S. PATENT DOCUMENTS 4,799,910 A * 1/1989 Kellough ..... A47C 15/006 441/131
5,167,554 A * 12/1992 Tager ..... B63B 34/50 441/131
5,439,405 A * 8/1995 Storey ..... A47C 15/006 441/127
6,589,089 B1 * 7/2003 Glass ..... B63B 34/50 441/130
6,702,380 B2 * 3/2004 Bedard ..... B60N 2/2809 297/250.1
6,749,474 B2 * 6/2004 Hsu ..... B63B 34/50 441/131
6,908,353 B2 * 6/2005 Zheng ..... B63B 34/50 441/131
6,948,991 B2 * 9/2005 Zhao ..... B63C 9/155 441/123
7,837,527 B2 * 11/2010 Debby ..... B63B 34/00 441/129
8,845,377 B2 * 9/2014 Berenson ..... B63B 34/50 441/131
10,286,257 B2 * 5/2019 Ison ..... A63B 31/00

* cited by examiner

*Primary Examiner* — S. Joseph Morano
*Assistant Examiner* — Jovon E Hayes
(74) *Attorney, Agent, or Firm* — HYIP

(57) ABSTRACT

The utility model relates to the field of articles for swimming, and relates to a lying ring for infants, comprising a main body; a bottom surface of the main body is provided with a chest supporting cushion, and the inner side of the main body is provided with a first waist protecting cushion and a second waist protecting cushion. The lying ring further comprises a first shoulder strap and a second shoulder strap; one end of the first shoulder strap and one end of the second shoulder strap extend to a back surface of the chest supporting cushion and are merged to form a crotch connecting strap; and the two shoulder straps are connected into a whole or integrated in one piece with the crotch connecting strap, so that the two shoulder straps are on the same connecting piece as two waist protecting cushions and the crotch connecting strap. The length of the crotch connecting strap and the shoulder straps can be adjusted at the same time.

9 Claims, 3 Drawing Sheets

LYING RING FOR INFANTS

TECHNICAL FIELD

The utility model relates to the field of articles for swimming, and particularly relates to a lying ring for infants.

BACKGROUND

At present, swimming rings for infants mainly include a neck type and an axillary type. The neck type swimming ring is easy to injure the cervical vertebrae of the infant and may severely compress the trachea to suffocate the infant. The axillary type swimming ring is easy to generate buoyancy imbalance, causing a user to roll.

Other types of swimming rings also have some potential safety hazards. Because the swimming rings and the infant are not fixed firmly, the infant is separated from the swimming rings and the infant falls into the water.

To solve the above problem, the applicant proposes a child swimming ring with Announcement No. CN 208085976 U to the State Intellectual Property Office. The child swimming ring comprises a swimming ring sheath, an inner core body and a waist and abdomen connecting strap. The inner core body is made of foam material. The swimming ring sheath is adapted with the shape of the inner core body and is sleeved on the inner core body. Shoulder straps are connected with the swimming ring sheath. The waist and abdomen connecting strap is connected with the shoulder straps. A child and the swimming ring are always in an integrated state through the synergy of the shoulder straps, the waist and abdomen connecting strap and the swimming ring sheath, to prevent the child from drowning and perform the effect of protecting the child in real time. The application is also applicable to the infants.

The above technical solution has advantages, but also has the following problems: two shoulder straps need to be worn separately; and the length of the shoulder straps and a crotch connecting strap need to be adjusted individually. Therefore, the wear process is complicated, and the time consumption for adjusting the wear length is long, which is easy to cause emotional irritability of the infant.

SUMMARY

The purpose of the utility model is to provide a lying ring for infants capable of adjusting the length of shoulder straps and a crotch connecting strap at one time without the need of individually wearing and adjusting the shoulder straps at short time consumption, so as to solve the problem of long time consumption for adjusting the length of the shoulder straps and the crotch connecting strap when the lying ring is worn.

To achieve the above purpose, the utility model adopts the following technical solution:

Compared with the prior art, the utility model has the following beneficial effects:

A lying ring for infants comprises a main body; a bottom surface of the main body is provided with a chest supporting cushion, and the inner side of the main body is provided with a first waist protecting cushion and a second waist protecting cushion. The lying ring further comprises a first shoulder strap and a second shoulder strap; one end of the first shoulder strap and one end of the second shoulder strap extend to a back surface of the chest supporting cushion and are merged to form a crotch connecting strap; and the first shoulder strap, the second shoulder strap and the crotch connecting strap are connected into a whole or integrated in one piece.

Further, a back surface of the chest supporting cushion is provided with an interlayer, and the first shoulder strap and the second shoulder strap penetrate through the interlayer and are connected with the crotch connecting strap to form a Y shape.

Further, the lying ring further comprises a first connecting piece; the first connecting piece is connected with the crotch connecting strap; and the first waist protecting cushion, the second waist protecting cushion, the first shoulder strap and the second shoulder strap are detachably connected with the first connecting piece.

Further, the first connecting piece is one of a buckle, a fastener, an eyesplice and a button.

Further, the first connecting piece is provided with a buckling groove; the first shoulder strap, the second shoulder strap, the first waist protecting cushion and the second waist protecting cushion are provided with plugs; and the plugs are adapted with the buckling groove.

Further, the first connecting piece is provided with a pressing button in correspondence to the plugs.

Further, the first connecting piece is provided with a movable button; the crotch connecting strap is connected with the first connecting piece through the movable button; and the crotch connecting strap is provided with a crotch protecting cushion.

Further, the first waist protecting cushion is also provided with a second connecting piece; and the second waist protecting cushion is detachably connected with the first waist protecting cushion through the second connecting piece.

Further, the second connecting piece is one of a fastener, an eyesplice, a velcro and a button.

Further, the main body is an open loop; the main body comprises an inner core body and a sheath; the sheath is adapted with the shape of the inner core body and is sleeved on the surface of the inner core body, and the inner core body is foam material.

Compared with the prior art, the utility model has the following beneficial effects:

1. The two shoulder straps and the crotch connecting strap are connected into a whole or integrated in one piece; and the two shoulder straps, the two waist protecting cushions and the crotch connecting strap are connected to the same connecting piece. When the length of the crotch connecting strap is adjusted, the length of the shoulder straps can also be adjusted. Therefore, the shoulder straps and the crotch connecting strap can be adjusted at one time; and at the same time, the structure is simple and installation and adjustment are convenient.

2. The back surface of the chest supporting cushion is provided with the interlayer, and the shoulder straps and the crotch connecting strap are adjusted to be within a predetermined track to prevent the shoulder straps and the crotch connecting strap from being scattered outside, so that the overall shape is more artistic and the structure is firmer.

In the figures: 1—main body; 2—chest supporting cushion; 3—first waist protecting cushion; 4—second waist protecting cushion; 5—first shoulder strap; 6—second shoulder strap; 7—crotch connecting strap; 8—interlayer; 9—first connecting piece; 10—buckling groove; 11—plug, 12—pressing button; 14—movable button; and 15—second connecting piece.

DETAILED DESCRIPTION

The technical solution of the utility model is further described below through specific embodiments.

Figure 1:
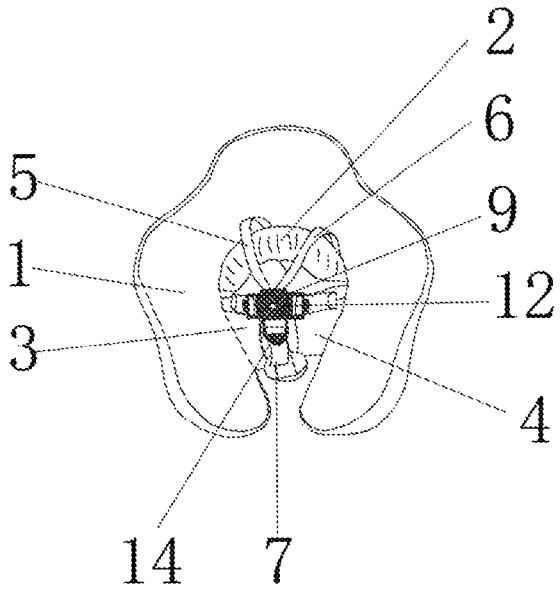
FIG. 1 is a structural diagram of a lying ring for infants in the utility model.
Figure 2:
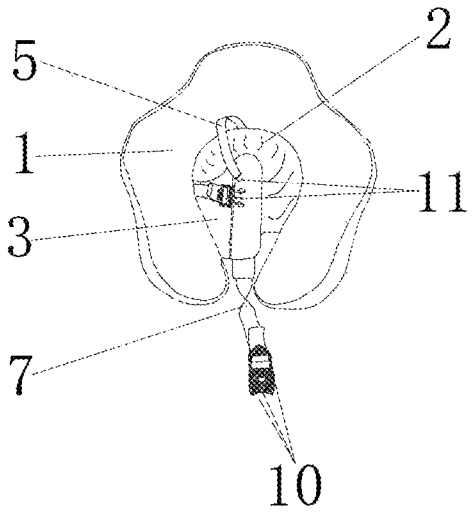
FIG. 2 is a structural diagram of a lying ring for infants comprising a first waist protecting cushion in the utility model.
Figure 3:
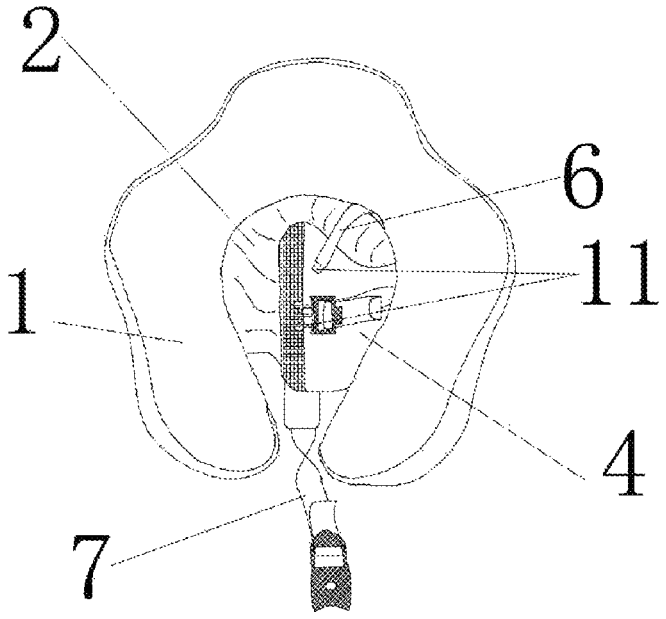
FIG. 3 is a structural diagram of a lying ring for infants comprising a second waist protecting cushion in the utility model.
Figure 4:
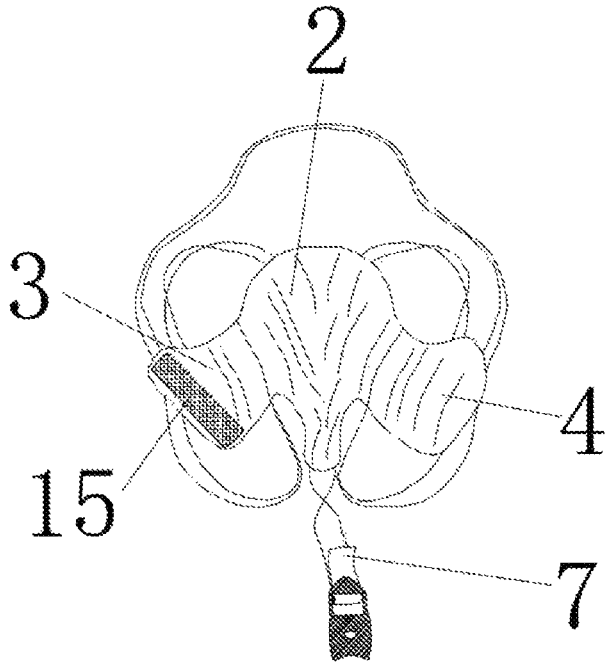
FIG. 4 is an expanded structural diagram of a lying ring for infants in the utility model.
Figure 5:
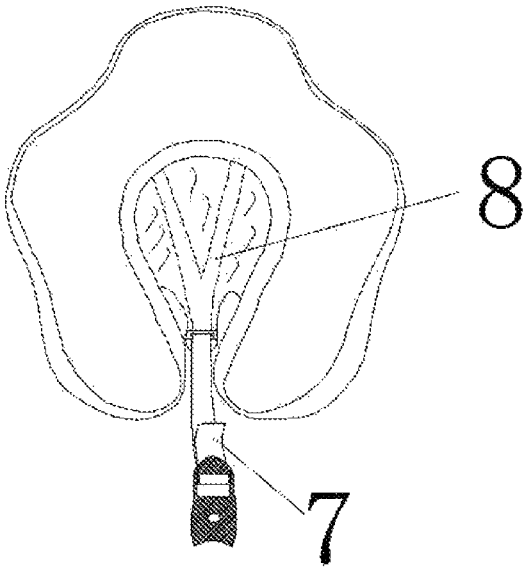
FIG. 5 is a structural diagram of a back surface of a lying ring for infants in the utility model.

The present embodiment is a lying ring for infants. As shown in FIGS. 1-5, the lying ring comprises a main body 1; a bottom surface of the main body 1 is provided with a chest supporting cushion 2, and the inner side of the main body 1 is provided with a first waist protecting cushion 3 and a second waist protecting cushion 4. The lying ring further comprises a first shoulder strap 5 and a second shoulder strap 6. One end of the first shoulder strap 5 and one end of the second shoulder strap 6 extend to a back surface of the chest supporting cushion 2 and are merged to form a crotch connecting strap 7. The first shoulder strap 5, the second shoulder strap 6 and the crotch connecting strap 7 are connected into a whole or integrated in one piece.

The chest supporting cushion 2 is mainly used to support the abdomen of an infant to perform the effect of protection. The shoulder straps cooperate with the waist protecting cushions and the crotch connecting strap 7 so that the lying ring is worn on a body of an infant, to protect the infant in real time during swimming and prevent the infant from separating from the lying ring and drowning. One end of the first shoulder strap 5 and one end of the second shoulder strap 6 penetrate through the supporting cushion 2 and are merged on the back surface of the supporting cushion 2 to form the crotch connecting strap 7. The shoulder straps and the crotch connecting strap 7 are connected into a whole or integrated in one piece. When the crotch connecting strap 7 is pulled, the first shoulder strap 5 and the second shoulder strap 6 are pulled together with the crotch connecting strap 7. Therefore, the present embodiment can adjust the length of the shoulder straps and the crotch connecting strap 7 at one time and can fix the infant and the lying ring within short time, so that the infant can swim in water as soon as possible, and simultaneously can avoid the emotional irritability and even crying of the infant caused by long-time adjustment of the shoulder straps and the crotch connecting strap 7.

Preferably, a back surface of the chest supporting cushion 2 is provided with an interlayer 8; and the first shoulder strap 5 and the second shoulder strap 6 penetrate through the interlayer 8 and are connected with the crotch connecting strap 7 to form a Y shape. The passage of the first shoulder strap 5 and the second shoulder strap 6 in the interlayer 8 is in the shape of V. The shoulder straps and the crotch connecting strap 7 are adjusted to be within a predetermined track by the interlayer 8 to prevent the shoulder straps and the crotch connecting strap 7 from being scattered outside, so that the overall shape is more artistic and the structure is firmer. The first shoulder strap 5, the second shoulder strap 6 and the crotch connecting strap 7 may not penetrate through the interlayer 8 and are directly exposed on the back surface of the chest supporting cushion 2.

The lying ring for infants in the present embodiment further comprises a first connecting piece 9; the first connecting piece 9 is connected with the crotch connecting strap 7; and the first waist protecting cushion 3, the second waist protecting cushion 4, the first shoulder strap 5 and the second shoulder strap 6 are detachably connected with the first connecting piece 9. The distance between the first waist protecting cushion 3 and the second waist protecting cushion 4 can be adjusted and the length of the first shoulder strap 5, the second shoulder strap 6 and the crotch connecting strap 7 can also be adjusted by adjusting the first connecting piece 9, thereby satisfying different needs.

The first connecting piece 9 is one of a buckle, a fastener, an eyesplice and a button. The first connecting piece 9 is provided with a buckling groove 10; the first shoulder strap 5, the second shoulder strap 6, the first waist protecting cushion 3 and the second waist protecting cushion 4 are provided with plugs 11; and the plugs 11 are adapted with the buckling groove 10. The first connecting piece 9 is provided with a pressing button 12 in correspondence to the plugs 11. If the plugs 11 need to be pulled out, the plugs 11 can be unlocked only by the pressing button 12. The end of the crotch connecting strap 7 is pulled down to simultaneously automatically pull the crotch connecting strap 7 and the shoulder straps. The first connecting piece 9 is provided with a movable button 14; the crotch connecting strap 7 is connected with the first connecting piece 9 through the movable button 14; and the movable button 14 and the first connecting piece 9 can be combined into a whole. Preferably, the movable button 14 is a tri-glide button. In addition, the crotch connecting strap 7 is also provided with a crotch protecting cushion to satisfy the comfort need of the crotch.

The first waist protecting cushion 3 is also provided with a second connecting piece 15; and the second waist protecting cushion 4 is detachably connected with the first waist protecting cushion 3 through the second connecting piece 15. The second connecting piece 15 is one of a fastener, an eyesplice, a velcro and a button. Preferably, the second connecting piece 15 is a velcro.

The main body 1 is an open loop. Legs of the infant are placed at the opening to increase the motion range of the legs and facilitate the infant in using the lying ring. The main body comprises an inner core body and a sheath; and the sheath is adapted with the shape of the inner core body and is sleeved on the surface of the inner core body. The inner core body is foam material which can avoid a safety problem caused by common air leakage of a swimming ring without the need of inflation and deflation operation. The sheath is waterproof material to prevent water from penetrating into the foam material, causing deterioration, and resulting in a decrease in the performance of the inner core body.

The use method of the present embodiment is as follows: firstly, the abdomen of the infant is placed on the chest supporting cushion 2, and the first waist protecting cushion 3 and the second waist protecting cushion 4 are pulled to the waist position of the infant and detachably connected by the second connecting piece 15. Then, the plugs 11 on the first shoulder strap 5, the second shoulder strap 6, the first waist protecting cushion 3 and the second waist protecting cushion 4 are inserted into the buckling groove 10 of the first connecting piece 9. Further, the crotch connecting strap 7 is used for fixing the crotch of the infant to prevent the infant from sliding down. Finally, the crotch connecting strap 7 and a shoulder connecting strap are adjusted to optimum length by adjusting the length of the crotch connecting strap 7 according to the actual size of the infant.

The above describes the embodiment of the utility model in detail. For those ordinary skilled in the art, changes may be made to specific embodiments in accordance with the thought provided by the utility model, and these changes shall also be considered as the protection scope of the utility model.

The invention claimed is:

1. A lying ring for infants, comprising a main body (1); a bottom surface of the main body (1) is provided with a chest supporting cushion (2), and the inner side of the main body (1) is provided with a first waist protecting cushion (3) and a second waist protecting cushion (4), characterized in that:

the lying ring further comprises a first shoulder strap (5) and a second shoulder strap (6); one end of the first shoulder strap (5) and one end of the second shoulder strap (6) extend to a back surface of the chest supporting cushion (2) and are merged to form a crotch connecting strap (7);

the first shoulder strap (5), the second shoulder strap (6) and the crotch connecting strap (7) are connected into a whole or integrated in one piece;

the main body (1) is an open loop; the main body comprises an inner core body and a sheath; the sheath is adapted with the shape of the inner core body and is sleeved on the surface of the inner core body; and the inner core body is foam material.

2. The lying ring for infants according to claim 1, characterized in that: a back surface of the chest supporting cushion (2) is provided with an interlayer (8); and the first shoulder strap (5) and the second shoulder strap (6) penetrate through the interlayer (8) and are connected with the crotch connecting strap (7) to form a Y shape.

3. The lying ring for infants according to claim 1, characterized in that:

the lying ring further comprises a first connecting piece (9); the first connecting piece (9) is connected with the crotch connecting strap (7); and the first waist protecting cushion (3), the second waist protecting cushion (4), the first shoulder strap (5) and the second shoulder strap (6) are detachably connected with the first connecting piece (9).

4. The lying ring for infants according to claim 1, characterized in that: the lying ring further comprises a first connecting piece (9); the first connecting piece (9) is connected with the crotch connecting strap (7); the first waist protecting cushion (3), the second waist protecting cushion (4), the first shoulder strap (5) and the second shoulder strap (6) are detachably connected with the first connecting piece (9); and the first connecting piece (9) is one of a buckle, a fastener, an eyesplice and a button.

5. The lying ring for infants according to claim 1, characterized in that: the lying ring further comprises a first connecting piece (9); the first connecting piece (9) is connected with the crotch connecting strap (7); the first waist protecting cushion (3), the second waist protecting cushion (4), the first shoulder strap (5) and the second shoulder strap (6) are detachably connected with the first connecting piece (9); the first connecting piece (9) is provided with a buckling groove (10); the first shoulder strap (5), the second shoulder strap (6), the first waist protecting cushion (3) and the second waist protecting cushion (4) are provided with plugs (11); and the plugs (11) are adapted with the buckling groove (10).

6. The lying ring for infants according to claim 1, characterized in that: the lying ring further comprises a first connecting piece (9); the first connecting piece (9) is connected with the crotch connecting strap (7); the first waist protecting cushion (3), the second waist protecting cushion (4), the first shoulder strap (5) and the second shoulder strap (6) are detachably connected with the first connecting piece (9); the first connecting piece (9) is provided with a buckling groove (10); the first shoulder strap (5), the second shoulder strap (6), the first waist protecting cushion (3) and the second waist protecting cushion (4) are provided with plugs (11); and the plugs (11) are adapted with the buckling groove (10); the first connecting piece (9) is provided with a pressing button (12) in correspondence to the plugs (11).

7. The lying ring for infants according to claim 1, characterized in that: the lying ring further comprises a first connecting piece (9); the first connecting piece (9) is connected with the crotch connecting strap (7); the first waist protecting cushion (3), the second waist protecting cushion (4), the first shoulder strap (5) and the second shoulder strap (6) are detachably connected with the first connecting piece (9); the first connecting piece (9) is provided with a movable button (14); the crotch connecting strap (7) is connected with the first connecting piece (9) through the movable button (14);

the crotch connecting strap (7) is provided with a crotch protecting cushion.

8. The lying ring for infants according to claim 1, characterized in that: the first connecting piece (9) is provided with a buckling groove (10); the first shoulder strap (5), the second shoulder strap (6), the first waist protecting cushion (3) and the second waist protecting cushion (4) are provided with plugs (11); the plugs (11) are adapted with the buckling groove (10); the first waist protecting cushion (3) is also provided with a second connecting piece (15); and the second waist protecting cushion (4) is detachably connected with the first waist protecting cushion (3) through the second connecting piece (15).

9. The lying ring for infants according to claim 1, characterized in that: the first connecting piece (9) is provided with a buckling groove (10); the first shoulder strap (5), the second shoulder strap (6), the first waist protecting cushion (3) and the second waist protecting cushion (4) are provided with plugs (11); the plugs (11) are adapted with the buckling groove (10); the first waist protecting cushion (3) is also provided with a second connecting piece (15); the second waist protecting cushion (4) is detachably connected with the first waist protecting cushion (3) through the second connecting piece (15); and the second connecting piece (15) is one of a fastener, an eyesplice, and a button.

* * * * *